US008570131B2

(12) United States Patent
Murillo

(10) Patent No.: US 8,570,131 B2
(45) Date of Patent: Oct. 29, 2013

(54) TRANSFORMER

(75) Inventor: Rafael Murillo, Zaragoza (ES)

(73) Assignee: ABB Technology AG, Zurich (SE)

( * ) Notice: Subject to any disclaimer, the term of this patent is extended or adjusted under 35 U.S.C. 154(b) by 0 days.

(21) Appl. No.: 13/451,063

(22) Filed: Apr. 19, 2012

(65) Prior Publication Data

US 2012/0206228 A1 Aug. 16, 2012

Related U.S. Application Data

(60) Provisional application No. PCT/EP2010/065608, filed on Oct. 18, 2010.

(30) Foreign Application Priority Data

Oct. 19, 2009 (EP) ..... 09173371

(51) Int. Cl.
*H01F 27/10* (2006.01)
*H01F 27/08* (2006.01)
*H01F 27/02* (2006.01)

(52) U.S. Cl.
USPC ..... 336/57; 336/60; 336/61; 336/94

(58) Field of Classification Search
USPC ..... 336/57, 60, 61, 90, 94; 29/602.1, 605, 29/606
See application file for complete search history.

(56) References Cited

U.S. PATENT DOCUMENTS 2,271,890 A * 2/1942 Rebhan ..... 361/40
2,388,566 A * 11/1945 Paluev ..... 336/57
2,853,540 A * 9/1958 Camilli et al. ..... 174/17 GF
3,164,666 A * 1/1965 Camilli ..... 174/17 R
3,614,693 A * 10/1971 Frey, III ..... 336/58
3,629,758 A * 12/1971 Pearce, Jr. ..... 336/57
4,196,408 A * 4/1980 Link ..... 336/94
4,488,134 A 12/1984 Pfeiffer
4,523,171 A 6/1985 Altmann et al.
6,157,282 A 12/2000 Hopkinson (Continued)

FOREIGN PATENT DOCUMENTS

EP 1733764 A2 12/2006
EP 1764487 A1 3/2007

(Continued)

OTHER PUBLICATIONS

International Search Report (PCT/ISA/210) issued on May 10, 2011, by European Patent Office as the International Searching Authority for International Application No. PCT/EP2010/065608.

(Continued)

*Primary Examiner* — Elvin G Enad
*Assistant Examiner* — Joselito Baisa
(74) *Attorney, Agent, or Firm* — Buchanan Ingersoll & Rooney PC

(57) ABSTRACT

A transformer containing an electrical active part arranged in an insulating space and including primary and secondary winding wound around a magnetic core. and radially spaced apart from each other by a winding space having an insulation fluid. A block defines a compartment closed and separated from a remaining insulating space, the compartment being at least partially arranged within the winding space. The compartment contains an insulation fluid different from insulation fluid in the remaining insulating space, and having a higher dielectric breakdown field strength than the insulation fluid in the remaining insulating space.

27 Claims, 1 Drawing Sheet

(56) References Cited

U.S. PATENT DOCUMENTS

| | | | |
|---|---|---|---|
| 2005/0263737 | A1 | 12/2005 | Minor et al. |
| 2008/0033201 | A1 | 2/2008 | Hof et al. |
| 2009/0056333 | A1 | 3/2009 | Schwiegel et al. |
| 2009/0183856 | A1 | 7/2009 | Bulinski et al. |
| 2011/0162366 | A1 | 7/2011 | Schwiegel et al. |

FOREIGN PATENT DOCUMENTS

| | | | |
|---|---|---|---|
| EP | 1918044 | A1 * | 5/2008 |
| FR | 1070676 | A | 8/1954 |
| WO | WO 2004/090177 | A1 | 10/2004 |

OTHER PUBLICATIONS

Written Opinion (PCT/ISA/237) issued on May 10, 2011, by European Patent Office as the International Searching Authority for International Application No. PCT/EP2010/065608.

International Preliminary Report on Patentability (PCT/IPEA/409) issued on Feb. 9, 2012, by European Patent Office as International Preliminary Examining Authority for International Application No. PCT/EP2010/065608.

European Search Report dated Apr. 6, 2012 for European Application No. 09173371.7.

* cited by examiner

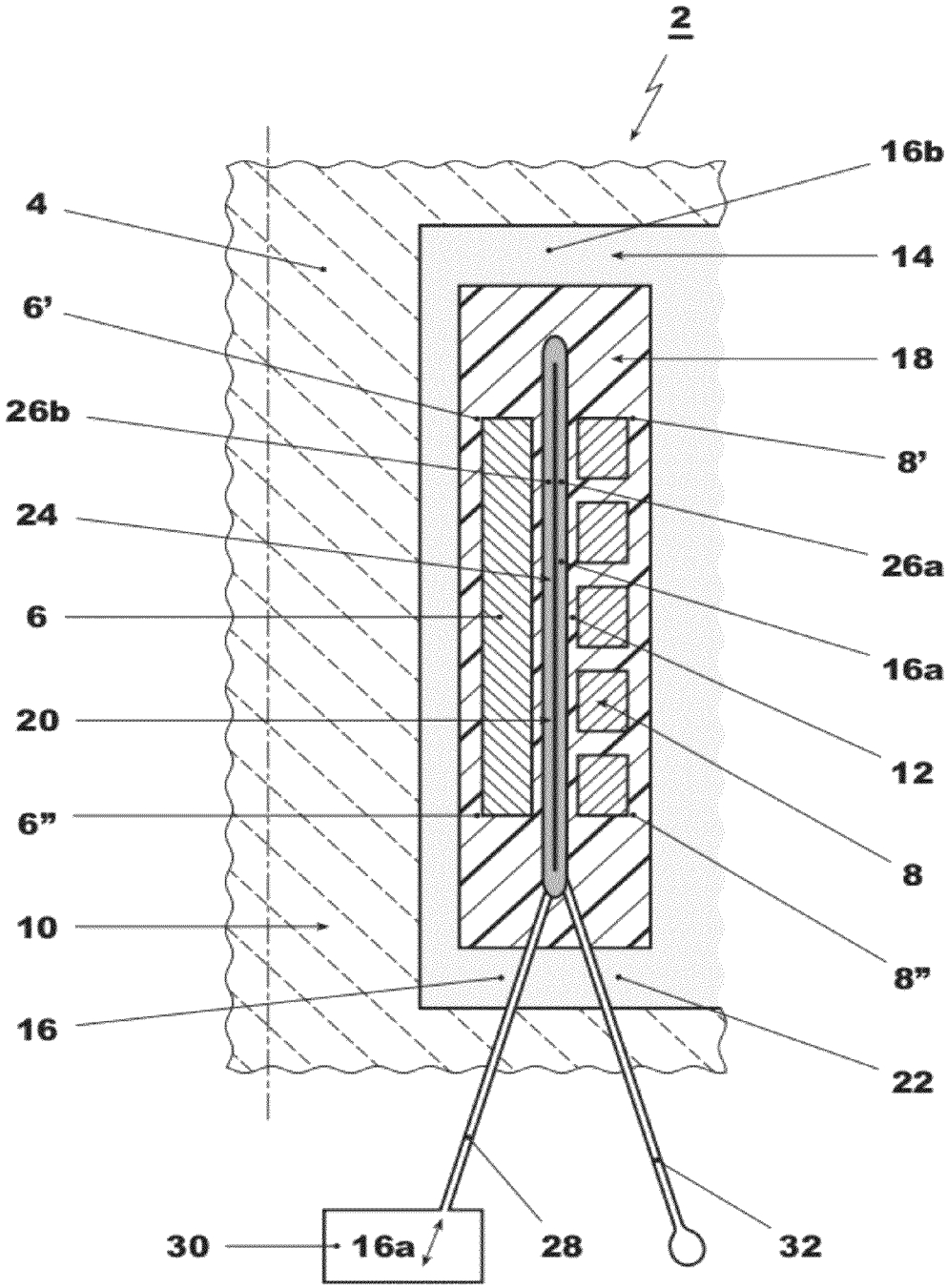
2
16b
4
14
6'
18
26b
8'
24
26a
6
16a
20
12
6"
8
10
8"
16
22
30
16a
28
32

TRANSFORMER

RELATED APPLICATION

This application claims priority as a continuation application under 35 U.S.C. §120 to PCT/EP2010/065608, which was filed as an International Application on Oct. 18, 2010 designating the U.S., and which claims priority to European Application 09173371.7 filed in Europe on Oct. 19, 2009. The entire contents of these applications are hereby incorporated by reference in their entireties.

FIELD

The present disclosure relates to transformers, such as a transformer operated at a voltage in an exemplary range from 10 to 300 kV, such as from 20 to 150 kV, or from 36 to 110 kV, or at about 72.5 kV.

Transformers are known and include devices that transfer electrical energy from one circuit to another through inductively coupled conductors (e.g., transformer windings). The windings are wound around a magnetic core. A current in the first ("primary") winding creates a magnetic field in the magnetic core, the magnetic field inducing a voltage in the second ("secondary") winding. This effect is called mutual induction.

The components of the electrical active part, which includes the windings and the magnetic core, are insulated from each other depending on the dielectric specifications between them.

With regard to the insulation, two exemplary types of transformers can be distinguished:

In a liquid or gas transformer, on the one hand, the electrical active part including the windings and the magnetic core, is arranged in a tank or vessel, which is filled with a dielectric insulation medium having higher insulating properties than air. The insulation medium is a liquid, such as oil, silicone or midel, in a liquid-insulated transformer, and a gas, such as $SF_6$ or $N_2$ either at atmospheric or elevated pressure, in a gas-insulated transformer.

A dry transformer, on the other hand, is devoid of a tank, and the electrical active part is thus surrounded by air at atmospheric pressure.

For a voltage higher than 36 kV, gas or liquid transformers can be used. Due to the relatively high insulating performance of the insulation medium, the clearance between the components of the electrical active part is relatively small. These transformers can be relatively complex and—due to the use of a tank and of an insulation medium different than air—relatively costly. Also, a cooling mechanism can be used in such transformers in order to actively cool the insulating space, and in particular the space between the windings. The cooling mechanism can further contribute to the complexity and the high cost of gas and liquid transformers.

Dry transformers, which have been used up to a voltage of 36 kV, are less complex, but can have large clearances due to the relatively low insulating performance of air. Thus, the spatial requirements of a dry transformer are relatively demanding and its weight is relatively high. Due to the amount of material involved, dry transformers can thus be relatively costly.

SUMMARY

A transformer is disclosed, comprising: an electrical active part arranged in an insulating space and including a primary winding, a secondary winding and a magnetic core, said primary and secondary windings being wound around the magnetic core and being radially spaced apart from each other by a winding space which contains a first insulation fluid; and a block defining a compartment closed and separated from a remaining insulating space, said compartment being at least partially arranged within the winding space, the closed compartment containing a second insulation fluid which is different from the first insulation fluid in the remaining insulating space of the transformer, the second insulation fluid in the closed compartment having a higher dielectric breakdown field strength than the first insulation fluid in the remaining insulating space.

A method of performing voltage transformation is also disclosed, comprising: applying a voltage to a transformer which includes an electrical active part arranged in an insulating space and including a primary winding, a secondary winding and a magnetic core, said primary and secondary windings being wound around the magnetic core and being radially spaced apart from each other by a winding space which contains a first insulation fluid, and including a block defining a compartment closed and separated from a remaining insulating space, said compartment being at least partially arranged within the winding space, the closed compartment containing a second insulation fluid which is different from the first insulation fluid in the remaining insulating space of the transformer, the second insulation fluid in the closed compartment having a higher dielectric breakdown field strength than the first insulation fluid in the remaining insulating space; and operating the transformer at a voltage in a range from 10 kV to 300 kV.

BRIEF DESCRIPTION OF THE DRAWING

Exemplary embodiments are further illustrated by way of the drawings, wherein:

FIG. 1 schematically shows a sectional view on a part of a transformer according to an exemplary embodiment of the present invention.

DETAILED DESCRIPTION

An exemplary transformer, which—even if designated for relatively high voltages—is disclosed which can allow for a very simple and compact design and at the same time also for a substantial decrease in the manufacturing cost.

The transformer can include a block, which defines a compartment closed and separated from the remaining insulating space of the transformer. The closed compartment is at least partially arranged within the space between the windings, (e.g., within the winding space).

The closed compartment can include an insulation fluid which is different from the insulation fluid in the remaining insulating space of the transformer, the insulation fluid in the closed compartment having a higher dielectric breakdown field strength than the insulation fluid in the remaining insulating space.

Exemplary embodiments make use of a finding that a clearance between the windings has a much higher impact on the overall manufacturing cost of the transformer than for example the clearance between the high voltage winding and the magnetic core. Specifically, the clearance between the windings is related to the transformer's impedance, which has an impact on the number of turns of the windings and on the cross section area of the magnetic core. Windings of an exemplary transformer according to the present disclosure are circular windings.

Due to the presence of a closed compartment, an insulating fluid having a particularly high dielectric performance, for example, a high dielectric breakdown field strength, can be provided selectively where the dielectric performance is of major importance, (e.g., in the winding space). Thus, an exemplary clearance between the windings is, according to the present disclosure significantly reduced, which goes along with a lower impedance of the transformer, a higher number of turns in the windings, a reduction in the cross sectional area of the magnetic core, and ultimately also in a reduction of the manufacturing cost.

In the remaining insulation space outside the closed compartment, air at atmospheric pressure can be used without significantly increasing the weight of the transformer, and hence the spatial dimensions of the transformer are increased only moderately and a compact transformer can be achieved without requiring a tank.

Thus, compared to oil or gas insulated transformers, economisation is according to the exemplary embodiments achieved by eliminating the cost of a tank and of a major part of the insulation medium. Compared to dry transformers, economisation is according to exemplary embodiments achieved by decreasing the amount of material for the magnetic core. The economic impact of this second aspect is quite substantial, which is emphasized by the fact that in known dry transformers the material cost of the magnetic core contributes to about one half of the overall cost of the transformer.

Due to the high insulating performance in the winding space, an exemplary transformer of the present disclosure can be used up to relatively high voltages.

Thus, exemplary embodiments can combine advantages of a dry transformer with the advantages of a liquid or gas transformer.

According to an exemplary embodiment, the closed compartment corresponds at least approximately to the winding space.

The insulation fluid used in the closed compartment and the remaining insulating space of the transformer according to exemplary embodiments, can be in liquid or gaseous phase. It is also thinkable that the insulation fluid forms a two-phase system comprising a first part in liquid and a second part in gaseous phase.

For example, the insulation fluid in the closed compartment can be an insulation gas containing or essentially (e.g., 90%, or lesser or greater) consisting of $SF_6$ or air at high pressure or any other insulation gas having a high dielectric performance, for example, having a high dielectric breakdown field strength. Alternatively, the insulation fluid can be an insulation liquid, for example selected from the group consisting of Midel 7131® (M&I Materials Limited), silicone oil and mineral oil.

According to a further exemplary embodiment, the closed compartment can include an insulation gas which has a higher pressure than the insulation gas in the remaining space of the transformer. This can be favourable due to the fact that the dielectric performance of the insulation fluid can be enhanced by increasing its pressure. For example, air at an absolute pressure of 5 atm (506625 Pa) has a dielectric strength which is about 3 times higher than in air at atmospheric pressure, so that it is possible to reduce the clearance between the primary (high voltage) and the secondary (low voltage) winding by about 60% to 70%.

Apart from air, an insulation gas selected from the group of $N_2$, $CO_2$, $SF_6$, or an insulation gas mixture selected from the group of $SF_6$ in $CO_2$ (the molar ratio of $SF_6$ being, for example, about 1%) or of $SF_6$ in $N_2$ (the molar ratio of $SF_6$ being, for example, about 5% to 10%) have been found particularly well suited if used at an absolute pressure in a range of about 2 atm (202650 Pa) to 5 atm (506625 Pa).

According to an exemplary embodiment, the insulation fluid includes a fluoroketone having from 4 to 12 carbon atoms. These fluoroketones have surprisingly been found to have high insulation capabilities or insulation performance, for example a high dielectric strength (or breakdown field strength), and at the same time an extremely low global warming potential (GWP).

For example, the fluoroketone according to this exemplary embodiment has the general structure:

R1-CO—R2 wherein R1 and R2 are at least partially fluorinated chains, the chains being independently from each other linear or branched and having from 1 to 10 carbon atoms. The definition encompasses both perfluorinated ketones as well as hydrofluorinated ketones.

The fluoroketone can have 6 carbon atoms (also referred to as a C6-fluoroketone). As mentioned above, the C6-fluoroketone can be a perfluorinated ketone (having the molecular formula $C_6F_{12}O$) or a hydrofluorinated ketone.

If an insulation gas is used, it can be a gas mixture, which for example includes the above mentioned fluoroketone together with air or at least one air component, for example selected from the group consisting of carbon dioxide ($CO_2$), oxygen ($O_2$) and nitrogen ($N_2$), as buffer or carrier gas. Alternatively, the insulation gas can substantially consist of fluoroketone.

Among the most preferred fluoroketones having 6 carbon atoms for an exemplary embodiment, dodecafluoro-2-methylpentan-3-one has been found to be particularly preferred for its high insulating properties and its extremely low GWP.

Dodecafluoro-2-methylpentan-3-one (also named 1,1,1,2,2,4,5,5,5-nonafluoro-4-(trifluoromethyl)-3-pentanone, perfluoro-2-methyl-3-pentanone or $CF_3CF_2C(O)CF(CF_3)_2$) has previously only been considered useful for completely different applications, namely the processing of molten reactive metals (as referred to in WO 2004/090177), for the cleaning of a vapour reactor (as referred to in WO 02/086191) and in fire extinction systems, or in liquid form for cooling of electronic systems, or for the Rankine-process in small power plants (as referred to in EP-A-1764487).

Dodecafluoro-2-methylpentan-3-one is clear, colorless and almost odourless. Its structural formula is given in the following:

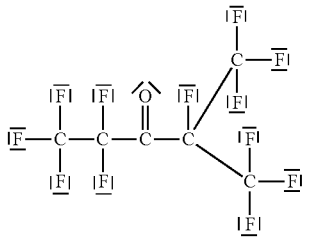

Dodecafluoro-2-methylpentan-3-one has an average lifetime in the atmosphere of about 5 days and its GWP is only about (e.g., ±10%) 1. In addition, its ozone depletion potential (ODP) is zero. Thus, the environmental load is much lower than the one of known insulation gases.

In addition, dodecafluoro-2-methylpentan-3-one is non-toxic and offers outstanding margins of human safety.

Dodecafluoro-2-methylpentan-3-one has a boiling point of 49.2° C. at 1 bar. Its vapour pressure (e.g., the pressure of the vapor in equilibrium with its non-vapor phases), is about 40 kPa at 25° C. Thus, a partial pressure of dodecafluoro-2-methylpentan-3-one sufficient for providing excellent dielectric properties can be achieved even at relatively low temperatures.

According to a further exemplary embodiment, the windings are embedded in the material of the block. In this embodiment, the material of the block further contributes to the insulation between the windings.

The permittivity of the material of the block is, for example, higher than the permittivity of the insulation fluid comprised in the closed compartment. For example, the permittivity of the material of the block is higher by a factor of at least 1.5, and, for example, more preferably, by a factor higher than 3.

Due to the lower permittivity of the insulation fluid in the closed compartment compared to the permittivity of the material of the block, the dielectric stress in the block material and discharge phenomena are reduced, and thus very low. Thus, the dielectric reliability and the lifetime of the block material can be improved and are independent on its quality due to the absence of discharge phenomena.

According to an exemplary preferred embodiment, the block is made of an epoxy resin. The epoxy resin has a relative permittivity of about 4.3, which is thus much higher than for example in air (having a relative permittivity of 1) and dodecafluoro-2-methylpentan-3-one (having a relative permittivity of 1.84).

In order to further improve the dielectric performance achieved in the winding space, the closed compartment can, according to a further exemplary embodiment, be divided by at least one barrier into at least two sub-compartments.

According to a further exemplary embodiment, the transformer includes a pressure control system designated to control the pressure in the closed compartment. Variations in the pressure caused by for example gas leakage or a change in the temperature can be efficiently compensated for by means of the pressure control system.

In order to allow the block to be cooled, an exemplary transformer includes a cooling system, the cooling system including means for circulating the insulation fluid in a closed circuit from the closed compartment to an external space where heat is released. This is particularly preferred for exemplary embodiments in which heating is an issue, because the winding space may not be cooled by convection of the insulation fluid as in known dry and gas/liquid transformers mentioned above. For example, the cooling system circulating means can include a pump which allows the insulation fluid to circulate between the closed compartment and an external cooling space, in which the insulation fluid is cooled for example by means of an external heat exchanger.

An exemplary transformer of the present disclosure is particularly suitable for exemplary use at a voltage in the range from 10 kV to 300 kV, preferably from, e.g., 20 kV to 150 kV, more preferably from, e.g., 36 kV to 110 kV, and most preferably at about, e.g., 72.5 kV. This is due to the fact that in the ranges mentioned, a maximum reduction of material required and thus a corresponding saving in cost can be achieved.

The transformer 2 according to FIG. 1 includes an electrical active part 4, which includes a primary winding 8, a secondary winding 6 and a magnetic core 10 as electrical active part components.

The windings 6, 8 are wound around the magnetic core 10 and are radially spaced apart from each other by a winding space 12. In the embodiment given in FIG. 1, the radially inner, secondary winding 6 is a low voltage winding and the radially outer, primary winding 8 is a high voltage winding.

The electrical active part 4 is arranged in an insulating space 14 which includes an insulation fluid 16.

According to FIG. 1, the windings 6, 8 are embedded in a block 18 made of an epoxy resin, said block 18 defining a closed compartment 20 separated from the remaining insulating space 22. This closed compartment 20 is arranged between the windings 6, 8 and thus within the winding space 12. In the embodiment shown in FIG. 1, the closed compartment 20 has an elongate form and with its ends protrudes the upper ends 6', 8' and the lower ends 6", 8" of the windings 6, 8. In the closed compartment 20, a longitudinally extending barrier 24 is arranged, dividing the closed compartment 20 into two sub-compartments 26*a*, 26*b*. The solid barrier 24 shall prevent charged components of the insulating fluid 16*a* to be accelerated electrically in the closed compartment 20 and to induce any flashover.

The fact that the closed compartment 20 arranged within the winding space 12 is completely separated from the remaining insulating space 22 allows the closed compartment 20 to comprise an insulation fluid 16*a* being different from the insulation fluid 16*b* of the remaining insulating space 22 and/or having a different pressure. Thus, a specifically high dielectric strength can be provided selectively in the winding space 12.

The electrical active part can be enclosed by a tank (not shown), such as in any known liquid or gas transformer, and thus be arranged in a closed insulating space. Alternatively, the transformer 2 can be devoid of a tank, such as in any known dry transformer. The insulation fluid in the remaining insulating space 22 outside the closed compartment 20 is in this latter embodiment air at atmospheric pressure.

FIG. 1 also shows schematically a cooling system 28 adapted for cooling the block 18. The cooling system 28 can include means for circulating the insulation fluid 16*a* in a closed circuit from the closed compartment 20 to an external space 30 where heat is released. This can be particularly preferred for exemplary embodiments in which heating is an issue, because the winding space 12 cannot be cooled by convection of the insulation fluid 16 or 16*a*, 16*b* as in known dry and gas/liquid transformers. For example, the cooling system 28 may include a pump which allows the insulation fluid 16*a* comprised in the otherwise closed compartment 20 to circulate between the closed compartment 20 and the external cooling space 30, in which the insulation fluid 16*a* is cooled for example by means of an external heat exchanger.

FIG. 1 furthermore shows schematically an embodiment with the transformer 2 having a pressure control system 32 designated to control the pressure in the closed compartment 20. Variations in the pressure caused by for example gas leakage or a change in the temperature can be efficiently compensated for by means of the pressure control system 32.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMBERS

2 transformer
4 electrical active part
6 secondary winding
8 primary winding

10 magnetic core
12 winding space, winding interstitial space
14 insulating space
16 insulation fluid
16*a* insulation fluid comprised in closed compartment
16*b* insulation fluid comprised in remaining insulating space
18 block
20 closed compartment
22 remaining insulating space
24 barrier
26*a*, 26*b* sub-compartments
28 cooling system
30 external space, heat exchange or cooling space
32 pressure control system.

The invention claimed is:

1. A transformer comprising:

an electrical active part arranged in an insulating space and including a primary winding, a secondary winding and a magnetic core, said primary and secondary windings being wound around the magnetic core and being radially spaced apart from each other by a winding space which contains a first insulation fluid in a remaining insulating space of the transformer; and a block comprises a material defining a compartment closed and separated from the remaining insulating space, the primary and secondary windings being embedded in the material of the block, said compartment being at least partially arranged within the winding space, the closed compartment containing a second insulation fluid which is different from the first insulation fluid in the remaining insulating space of the transformer, the second insulation fluid in the closed compartment having a higher dielectric breakdown field strength than the first insulation fluid in the remaining insulating space.

2. Transformer according to claim 1, wherein the compartment corresponds at least approximately to the winding space.

3. Transformer according to claim 2, wherein the first and/or second insulation fluid comprises:

a fluoroketone having from 4 to 12 carbon atoms.

4. Transformer according to claim 2, wherein the compartment comprises:

an insulation gas which has a higher pressure than an insulation gas in the remaining space of the transformer.

5. Transformer according to claim 4, wherein the primary and secondary windings are embedded in material of the block.

6. Transformer according to claim 5, wherein the compartment is divided by at least one barrier into at least two sub-compartments.

7. Transformer according to claim 6, comprising: a pressure control system for controlling pressure in the compartment.

8. Transformer according to claim 7, comprising: a cooling system for cooling the block, said cooling system having means for circulating the first insulation fluid in a closed circuit from the compartment to an external space, where heat will be released during operation.

9. Transformer according to claim 1, wherein the compartment comprises:

an insulation gas which has a higher pressure than an insulation gas in the remaining space of the transformer.

10. Transformer according to claim 9, wherein the first and/or second insulation fluid comprises:

a fluoroketone having from 4 to 12 carbon atoms.

11. Transformer according to claim 1, wherein the first and/or second insulation fluid comprises:

a fluoroketone having from 4 to 12 carbon atoms.

12. Transformer according to claim 11, wherein the first and/or second insulation fluid is selected from the group of $SF_6$, air at high pressure, midel, mineral oil, and silicone oil.

13. Transformer according to claim 11, wherein a relative permittivity of the material of the block is higher than a relative permittivity of the first insulation fluid in the compartment.

14. Transformer according to claim 1 wherein the first and/or second insulation fluid comprises:

a fluoroketone having from 4 to 10 carbon atoms.

15. Transformer according to claim 1 wherein the first and/or second insulation fluid comprises:

a fluoroketone having from 4 to 8 carbon atoms.

16. Transformer according to claim 1 wherein the first and/or second insulation fluid comprises:

a fluoroketone having one of 5, 6, or 7 carbon atoms.

17. Transformer according to claim 16, wherein the first and/or second insulation fluid is dodecafluoro-2-methylpentan-3-one.

18. Transformer according to claim 1, wherein the first and/or second insulation fluid is selected from the group of $SF_6$, air at high pressure, midel, mineral oil, and silicone oil.

19. Transformer according to claim 1, wherein a relative permittivity of the material of the block is higher than a relative permittivity of the first insulation fluid in the compartment.

20. Transformer according to claim 1, wherein the block is made of an epoxy resin.

21. Transformer according to claim 1, wherein the compartment is divided by at least one barrier into at least two sub-compartments.

22. Transformer according to claim 1, comprising:

a pressure control system for controlling pressure in the compartment.

23. Transformer according to claim 1, comprising:

a cooling system for cooling the block, said cooling system having means for circulating the first insulation fluid in a closed circuit from the compartment to an external space, where heat will be released during operation.

24. Transformer according to claim 1, wherein a relative permittivity of the material of the block is higher than a relative permittivity of the first insulation fluid in the compartment, by a factor of at least 1.5.

25. Transformer according to claim 1, wherein a relative permittivity of the material of the block is higher than a relative permittivity of the first insulation fluid in the compartment by a factor higher than 3.

26. A transformer comprising:

an electrical active part arranged in an insulating space and including a primary winding, a secondary winding and a magnetic core, said primary and secondary windings being wound around the magnetic core and being radially spaced apart from each other by a winding space which contains a first insulation fluid in a remaining insulating space; and a block comprises a material defining a compartment closed and separated from the remaining insulating space, said compartment being at least partially arranged within the winding space, the closed compartment containing a second insulation fluid which is different from the first insulation fluid in the remaining insulating space of the transformer, the second insulation fluid in the closed compartment having a higher dielectric breakdown field strength than the first insulation fluid in the remaining insulating space, and wherein the first and/or second insulation fluid comprises a fluoroketone.

27. Method of performing voltage transformation, comprising:

applying a voltage to a transformer which includes an electrical active part arranged in an insulating space and including a primary winding, a secondary winding and a magnetic core, said primary and secondary windings being wound around the magnetic core and being radially spaced apart from each other by a winding space which contains a first insulation fluid in a remaining insulating space of the transformer;

a block comprises a material defining a compartment closed and separated from the remaining insulating space, the primary and secondary windings being embedded in the material of the block, said compartment being at least partially arranged within the winding space, the closed compartment containing a second insulation fluid which is different from the first insulation fluid in the remaining insulating space of the transformer, the second insulation fluid in the closed compartment having a higher dielectric breakdown field strength than the first insulation fluid in the remaining insulating space; and operating the transformer at a voltage in a range from 10kV to 300kV.

* * * * *